US009816739B2

(12) United States Patent
Tambovtsev et al.

(10) Patent No.: US 9,816,739 B2
(45) Date of Patent: Nov. 14, 2017

(54) REFRIGERATION SYSTEM AND REFRIGERATION METHOD PROVIDING HEAT RECOVERY

(75) Inventors: Alexander Tambovtsev, Mainz (DE); Christian Scheumann, Frankfurt (DE)

(73) Assignee: CARRIER CORPORATION, Farmington, CT (US)

( * ) Notice: Subject to any disclaimer, the term of this patent is extended or adjusted under 35 U.S.C. 154(b) by 454 days.

(21) Appl. No.: 14/241,984

(22) PCT Filed: Sep. 2, 2011

(86) PCT No.: PCT/EP2011/065196

§ 371 (c)(1),
(2), (4) Date: Feb. 28, 2014

(87) PCT Pub. No.: WO2013/029687

PCT Pub. Date: Mar. 7, 2013

(65) Prior Publication Data

US 2014/0223937 A1 Aug. 14, 2014

(51) Int. Cl.
*F25B 1/00* (2006.01)
*F25B 41/04* (2006.01)
(Continued)

(52) U.S. Cl.
CPC ..... *F25B 41/04* (2013.01); *F25B 6/02* (2013.01); *F25B 7/00* (2013.01);
(Continued)

(58) Field of Classification Search
CPC .. F25B 7/00; F25B 41/04; F25B 40/04; F25B 2339/047; F25B 2600/2507; F25D 3/08
See application file for complete search history.

(56) References Cited

U.S. PATENT DOCUMENTS 3,922,873 A 12/1975 Leonard
4,134,274 A 1/1979 Johnsen
(Continued)

FOREIGN PATENT DOCUMENTS

CH 697593 B1 12/2008
DE 2461787 A1 7/1976
(Continued)

OTHER PUBLICATIONS

International Search Report and Written Opinion for application PCT/EP/2011/065196 dated Jun. 8, 2012, 17 pages.

*Primary Examiner* — Elizabeth Martin
(74) *Attorney, Agent, or Firm* — Cantor Colburn LLP

(57) ABSTRACT

A refrigeration circuit comprises in the direction of flow of a refrigerant at least one compressor; at least one heat rejecting heat exchanger; at least one expansion device; and at least one evaporator. The refrigeration circuit further comprises at least one heat recovery heat exchanger having a refrigeration circuit side and heat recovery system side and being configured for transferring heat between the refrigeration circuit side and the heat recovery system side, wherein the refrigeration circuit side is fluidly connected in parallel to the at least one heat rejecting heat exchanger; and at least one regulation valve, configured for regulating the flow of refrigerant flowing through the refrigeration circuit side of the at least one heat recovery heat exchanger. The at least one regulation valve is switchable between an open position, a closed position, and at least one intermediate position.

26 Claims, 1 Drawing Sheet

(51) Int. Cl.
*F25B 6/02* (2006.01)
*F25B 7/00* (2006.01)

(52) U.S. Cl.
CPC . *F25B 2339/047* (2013.01); *F25B 2400/0403* (2013.01); *F25B 2400/075* (2013.01); *F25B 2400/13* (2013.01); *F25B 2400/23* (2013.01); *F25B 2600/2507* (2013.01); *F25B 2700/195* (2013.01); *F25B 2700/21161* (2013.01); *F25B 2700/21163* (2013.01)

(56) References Cited

U.S. PATENT DOCUMENTS

RE30,252 E 4/1980 Leonard
4,226,606 A 10/1980 Yaeger et al.
4,238,933 A * 12/1980 Coombs ..... F24D 11/0235 62/238.7
4,251,996 A 2/1981 Esformes et al.
4,281,519 A 8/1981 Spath et al.
4,316,367 A 2/1982 Yaeger et al.
5,115,645 A 5/1992 Abraham
5,551,249 A 9/1996 Van Steenburgh, Jr.
5,628,200 A 5/1997 Pendergrass
5,689,964 A 11/1997 Kawakita et al.
5,758,820 A 6/1998 Celorier, Jr. et al.
5,802,862 A 9/1998 Eiermann
5,906,104 A 5/1999 Schwartz et al.
5,937,663 A 8/1999 Chen et al.
6,006,528 A 12/1999 Arima et al.
6,041,613 A 3/2000 Morse et al.
6,158,229 A 12/2000 Aizawa
6,216,481 B1 4/2001 Kantchev
6,347,527 B1 2/2002 Bailey et al.
6,378,318 B1 * 4/2002 Jin ..... F25B 40/04 62/238.7
6,615,585 B2 9/2003 Tsuji
6,964,168 B1 11/2005 Pierson et al.
7,174,727 B2 2/2007 Kim et al.
7,178,358 B2 2/2007 Inaba et al.
7,197,886 B2 4/2007 Lesage et al.
7,237,394 B2 7/2007 Rigal et al.
7,237,405 B2 7/2007 Takegami et al.
7,266,970 B2 9/2007 Li
7,370,790 B2 5/2008 Martincikova et al.
7,441,589 B2 10/2008 Garrabrant et al.
7,950,230 B2 5/2011 Nishikawa et al.
2002/0092318 A1 * 7/2002 Tipton ..... F25B 39/02 62/510
2004/0255604 A1 12/2004 Longardner
2006/0042285 A1 * 3/2006 Heberle ..... B60H 1/322 62/236
2006/0064995 A1 3/2006 Rigal et al.
2006/0201175 A1 9/2006 Shapiro et al.
2006/0240369 A1 10/2006 Duesel, Jr. et al.
2007/0012418 A1 1/2007 Cho et al.
2007/0295018 A1 12/2007 Williams
2008/0245087 A1 10/2008 Orcutt
2009/0013705 A1 1/2009 Nishikawa et al.
2009/0077985 A1 3/2009 Takegami et al.
2009/0120110 A1 * 5/2009 Grabon ..... F24D 17/02 62/115
2009/0151388 A1 6/2009 Platt et al.
2009/0183697 A1 7/2009 Inui
2009/0255286 A1 10/2009 Solsona Caballer et al.
2009/0282848 A1 11/2009 Takegami et al.
2010/0000709 A1 1/2010 Chang
2010/0024444 A1 2/2010 Sharma et al.
2010/0132390 A1 6/2010 Platt et al.
2010/0139312 A1 6/2010 Takegami et al.
2010/0263392 A1 10/2010 Misselhorn
2010/0270005 A1 10/2010 Radhakrishnan et al.
2010/0326125 A1 12/2010 Sakae et al.
2011/0036113 A1 * 2/2011 Kopko ..... F25B 30/02 62/324.5

FOREIGN PATENT DOCUMENTS

EP 1262722 A2 12/2002
JP 11211270 8/1999

* cited by examiner

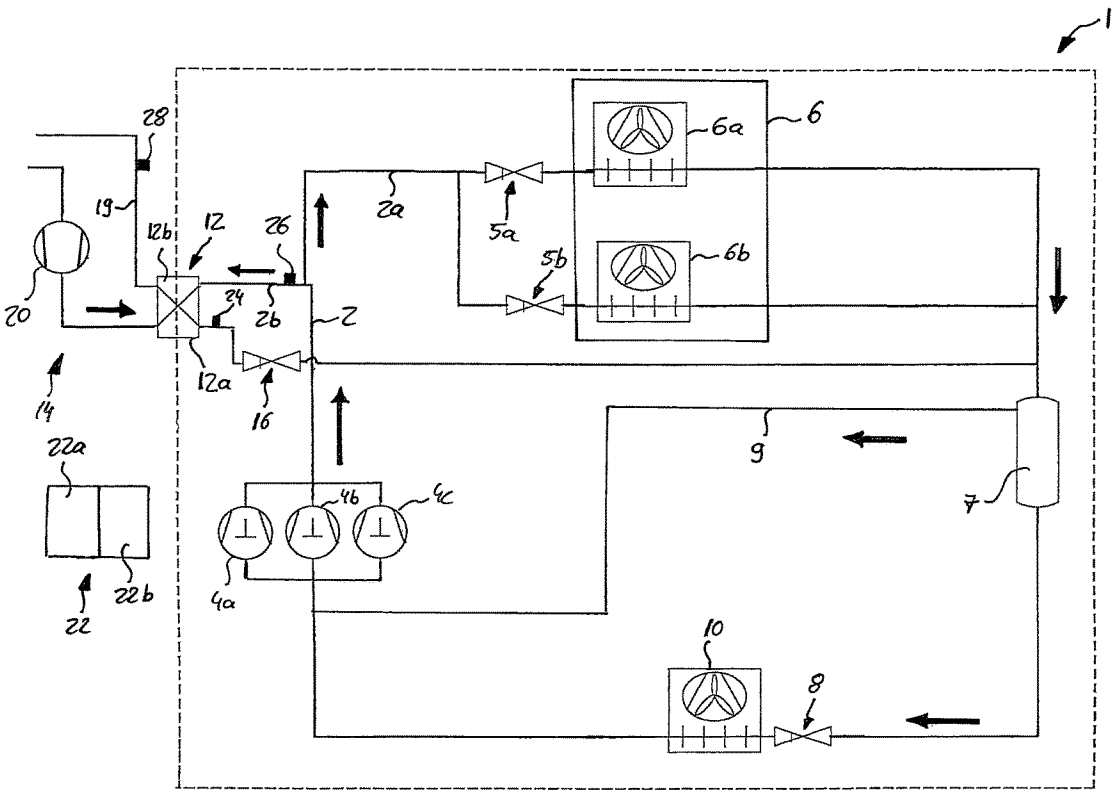
1
6
6a
6b
5a
5b
2a
2
26
26
24
12
12a
12b
28
19
20
14
16
4c
4b
4a
7
9
8
10
22a
22b
22

REFRIGERATION SYSTEM AND REFRIGERATION METHOD PROVIDING HEAT RECOVERY

The invention relates to a refrigeration system and a refrigeration method for providing heat recovery.

Cooling circuits of refrigeration installations can include heat recovery units which utilize the heat from the compressed hot refrigerant discharged from the compressor for heating. One example of such heat recovery is to use such heat to heat up water which can be used as warm or hot water for domestic use.

The demand for such warm or hot water for domestic use can vary substantially for different buildings and applications, and can vary significantly over time.

US 2009/120110 A1 discloses a method for providing controllable amounts of heat recovery from a refrigerant circuit. The method comprises the steps of providing a cooling circuit comprising a compressor, a condenser, an expansion device and an evaporator connected in series by refrigerant flow lines; providing a heat recovery circuit comprising a heat recovery heat exchanger, the heat recovery circuit being connected to the cooling circuit so that the heat recovery heat exchanger is in parallel with the condenser, and the heat recovery heat exchanger being in heat exchange relationship with a fluid to be heated based upon an end-user demand for heat; and selectively flowing refrigerant through the condenser of the cooling circuit in a cooling mode and the heat recovery heat exchanger of the heat recovery circuit in a heat recovery mode so as to maintain temperature of the fluid within a temperature band around a set point provided by the end user. A desired amount of between 0 and 100% of the system's heat transfer capability can be transferred to the fluid to be heated by periodically switching ("cycling") between the cooling mode and the heat recovery mode. This makes it necessary to perform multiple switching operations and results in changes of the heat transfer over time which leads to a continuously changing operation of the system and a quite complex control.

Accordingly, it would be beneficial to provide an energy-efficient refrigeration system and method with an improved control of the heat transferred from the refrigeration circuit to a heat recovery system, while providing sufficient flexibility to meet individual and changing heat demands on the heat recovery system side.

Exemplary embodiments of the invention comprise a refrigeration circuit circulating a refrigerant and comprising in the direction of flow of the refrigerant: at least one compressor; at least one heat rejecting heat exchanger; at least one expansion device; and at least one evaporator. A refrigeration circuit according to an exemplary embodiment of the invention further comprises at least one heat recovery heat exchanger having a refrigeration circuit side and heat recovery system side and being configured to transfer heat between the refrigeration circuit side and the heat recovery system side. The refrigeration circuit side is fluidly connected in parallel to the at least one heat rejecting heat exchanger of the refrigeration circuit for flowing circulating refrigerant through the refrigeration circuit side of the at least one heat recovery heat exchanger. The refrigeration circuit further comprises at least one regulation valve, which is configured to regulate the flow of refrigerant flowing through the refrigeration circuit side of the at least one heat recovery heat exchanger. The at least one regulation valve is switchable between an open position, in which the regulation valve is completely open, a closed position, in which the regulation valve is completely closed, and at least one intermediate position, in which the regulation valve is partially open having an opening degree/opening cross section which is smaller than in the open position.

Exemplary embodiments of the invention further include a method of operating a refrigeration circuit with a circulating refrigerant and comprising in the flow-direction of the refrigerant at least one compressor; at least one heat rejecting heat exchanger; at least one expansion device; at least one evaporator and at least one heat recovery heat exchanger, which comprises a refrigeration circuit side and heat recovery system side and is configured to transfer heat from the circulating refrigerant to a heat recovery system. The refrigeration circuit side of the heat recovery heat exchanger is connected in parallel to the heat rejecting heat exchanger for flowing refrigerant through the refrigeration circuit side. A regulation valve is configured to regulate the flow of refrigerant flowing through the refrigerant circuit side of the heat recovery heat exchanger and the method comprises the step of regulating the flow of refrigerant flowing through the refrigeration circuit side of the heat recovery heat exchanger by controlling the regulation valve to be switched between an open position, in which the regulation valve is completely open, a closed position, in which the regulation valve is completely closed, and at least one intermediate position in which the regulation valve is partially open having an opening degree/opening cross section which is smaller than in the open position.

An exemplary embodiment of the invention will be described in more detail with reference to the enclosed FIGURE.

The FIGURE shows a schematic view of an exemplary refrigeration circuit according to an embodiment of the invention.

The refrigeration circuit 1 is depicted in the middle and right-hand sides of the FIGURE inside the box surrounded by a dashed line. On the left-hand side of the FIGURE part of a heat recovery system 14 is shown.

The refrigeration circuit 1 comprises in flow direction of a refrigerant as indicated by arrows three compressors 4*a*, 4*b*, 4*c* connected in parallel for compressing the refrigerant to a relatively high pressure. The skilled person will easily understand that the number of three compressors 4*a*, 4*b*, 4*c* is only exemplary and any suitable number of compressors 4*a*, 4*b*, 4*c* including only one compressor 4*a* may be used, and that compressors connected in series can be provided as well.

A pressure line 2 attaches to the outlet side of the compressors 4*a*, 4*b*, 4*c* and branches into a first pressure line portion 2*a* leading to conventional air-cooled heat rejecting heat exchangers 6 and into a second pressure line portion 2*b* leading to a refrigeration circuit side 12*a* of a heat recovery heat exchanger 12.

The high pressure refrigerant leaving the compressors 4*a*, 4*b*, 4*c* flowing through the second pressure line portion 2*b* and the refrigeration circuit side 12*a* of the heat recovery heat exchanger 12 arranged downstream of the compressors 4*a*, 4*b*, 4*c* transfers heat to a heat receiving fluid flowing, as indicated by the arrow, through the heat recovery system side 12*b* of the heat recovery heat exchanger 12. The flow of the heat receiving fluid is driven by a fluid pump 20. A heat receiving fluid temperature sensor 28 is arranged in the fluid conduit 19 connected to the heat recovery system side 12*b* of the heat recovery heat exchanger 12, particularly at a position behind the heat recovery system side 12*b*, in order to measure the temperature of the heat receiving fluid leaving the heat recovery heat exchanger 12 that has been warmed up against the hot compressed refrigerant flowing through the refrigeration circuit side 12*a* of the heat recovery heat exchanger 12.

The flow of high pressure refrigerant flowing through the second pressure line portion 2*b* and the refrigeration circuit side 12*a* of the heat recovery heat exchanger 12 is controlled by means of a regulation valve 16 which is arranged downstream of the refrigeration circuit side 12*a* of the heat recovery heat exchanger 12.

The regulation valve 16 is switchable between an open position, in which the regulation valve 16 is completely open, a closed position, in which the regulation valve 16 is completely closed and does not allow any refrigerant to flow through the refrigeration circuit side 12*a* of a heat recovery heat exchanger 12, and at least one intermediate position, in which the regulation valve is partially open with a smaller opening degree as in the completely open position in order to allow a throttled flow of refrigerant to flow through the refrigeration circuit side 12*a* of a heat recovery heat exchanger 12.

Thus, the amount of heat transfer from the refrigerant circulating in the refrigeration circuit 1 to the heat receiving fluid flowing in the heat recovery system 14 via the heat recovery heat exchanger 12 may be controlled by means of the regulation valve 16. In an embodiment the regulation valve 16 comprises a plurality of intermediate positions, each of the intermediate positions representing a different opening degree/cross section allowing a fine adjustment of the amount of compressed hot refrigerant flowing through the refrigeration circuit side 12*a* of the heat recovery heat exchanger 12.

In another embodiment the opening degree/cross section of the regulation valve 16 is continuously adjustable between the closed position and the completely open position allowing to continuously regulate the flow of refrigerant flowing through the refrigeration circuit side 12*a* of the heat recovery heat exchanger 12.

As the regulation valve 16 is arranged downstream and not upstream of the heat recovery heat exchanger 12, it does not act as a throttle in the second portion 2*b* of the pressure line 2 upstream of the heat recovery heat exchanger 12 even when it is switched to an intermediate position. Such a throttle located upstream of the heat recovery heat exchanger 12 would undesirably expand the high pressure refrigerant before entering the heat recovery heat exchanger 12.

A refrigerant temperature sensor 24 and a refrigerant pressure sensor 26 are arranged in the second portion 2*b* of the pressure line 2 in order to measure the temperature and, respectively, the pressure of the refrigerant flowing through the refrigeration circuit side 12*a* of the heat recovery heat exchanger 12.

In the embodiment shown in the FIGURE, the temperature sensor 24 is arranged downstream of the heat recovery heat exchanger 12 in order to measure the temperature of the refrigerant after it has been cooled down in the refrigeration circuit side 12*a* of the heat recovery heat exchanger 12 in heat exchange against the heat receiving fluid flowing through the heat recovery system side 12*b* of the heat recovery heat exchanger 12.

In the embodiment shown in the FIGURE, the pressure sensor 26 is arranged upstream of the heat recovery heat exchanger 12. It is, however, possible, to arrange the pressure sensor 26 downstream of the heat recovery heat exchanger 12, as well, as long as it is arranged upstream of the regulation valve 16.

The outlet side of the regulation valve 16 is fluidly connected to a receiver 7, which is configured for collecting the refrigerant. Typically liquid refrigerant collects at the bottom portion of the receiver 7 and gaseous refrigerant collects in the upper gas space of the receiver 7.

An outlet of the receiver 7 is fluidly connected to an expansion device 8. Liquid refrigerant leaving the receiver 7 is expanded by the expansion device 8 and evaporated in an evaporator 10 which is arranged and fluidly connected downstream of the expansion device 8. When the refrigerant is evaporated in the evaporator 10 it transfers coldness to and absorbs heat from the environment before flowing back to the compressors 4*a*, 4*b*, 4*c* through the suction line connecting the evaporator 10 to the inlet side of the compressors 4*a*, 4*b*, 4*c*.

The skilled person will easily understand that although the exemplary embodiment shown in the FIGURE comprises only one expansion device 8 and only one evaporator 10 any suitable number of expansion devices 8 and evaporators 10 may be used.

After having left the compressors 4*a*, 4*b*, 4*c*, the portion of the refrigerant which does not flow through the refrigeration circuit side 12*a* of the heat recovery heat exchanger 12 flows through the second portion 2*a* of the pressure line 2 to at least one heat rejecting heat exchanger 6 which is configured to transfer heat from the refrigerant to the environment. The heat is for example transferred to ambient air or a cooling water circuit connected to the heat rejecting heat exchanger 6. If the heat is transferred to ambient air, the at least one heat rejecting heat exchanger 6 may comprise at least one fan in order to suck or blow ambient air through the heat rejecting heat exchanger 6 in order to enhance the transfer of heat from the refrigerant to the environment.

In the embodiment shown in the FIGURE two heat rejecting heat exchangers 6*a*, 6*b* are provided, which are connected parallel to each other. Respective switchable valves 5*a*, 5*b* are provided at the inlet sides of each of the heat rejecting heat exchangers 6*a*, 6*b* in order to selectively activate and deactivate the respective heat rejecting heat exchanger 6*a*, 6*b*.

The two heat rejecting heat exchangers 6*a*, 6*b* may be either separate, individual heat rejecting heat exchangers 6*a*, 6*b* or heat exchanger portions 6*a*, 6*b* of a common heat rejecting heat exchanger 6.

The switchable valves 5*a*, 5*b*, which may be implemented as motor-actuated ball valves, are respectively switchable only between a completely open and a completely closed position. Switching one of the switchable valves 5*a*, 5*b* to a partially opened position would provide a throttle within the pressure line 2*a* upstream of the at least one heat rejecting heat exchanger 6 which would act as an expansion device expanding the refrigerant circulating within the refrigeration circuit 1. This expansion is undesirable at a position upstream of the heat rejecting heat exchangers 6*a*, 6*b* as it would negatively affect the efficiency of the at least one heat rejecting heat exchanger 6.

The outlet sides of the heat rejecting heat exchangers 6*a*, 6*b* are fluidly connected to the receiver 7 for delivering the refrigerant leaving the heat rejecting heat exchanger(s) 6*a*, 6*b* to the receiver 7. Thus the portion of refrigerant flowing through the first pressure line portion 2*a*, the switchable valves 5*a*, 5*b* and the heat rejecting heat exchangers 6*a*, 6*b* mixes in the receiver 7 with the portion of refrigerant flowing through the second pressure line portion 2*b*, the refrigeration circuit side 12*a* of the heat recovery heat exchanger 12, and the regulation valve 16, before the refrigerant is delivered to the expansion device 8 and the evaporator 10, as described before.

Providing at least two heat rejecting heat exchangers 6*a*, 6*b* or heat exchanger portions 6*a*, 6*b* in parallel which may be selectively activated and/or deactivated by respectively associated switchable valves 5*a*, 5*b* allows to adjust the heat rejecting capacity provided by the heat rejecting heat exchangers 6*a*, 6*b* or heat exchanger portions 6*a*, 6*b* to changing needs.

The two heat rejecting heat exchangers 6*a*, 6*b* or heat exchanger portions 6*a*, 6*b* may have the same heat rejecting capacity allowing to switch the heat rejecting capacity provided by the heat rejecting heat exchangers 6*a*, 6*b* or heat exchanger portions 6*a*, 6*b* between the full available heat rejecting capacity (100%), when both switchable valves 5*a*, 5*b* are open and both heat rejecting heat exchangers 6*a*, 6*b* or heat exchanger portions 6*a*, 6*b* are active, and half of the maximum heat rejecting capacity (50%) available, when only one of the switchable valves 5*a*, 5*b* is open and the second switchable valve 5*a*, 5*b* is closed so that only one of the heat rejecting heat exchangers 6*a*, 6*b* or heat exchanger portions 6*a*, 6*b* is active.

In another exemplary embodiment the heat rejecting capacity of a second of the heat rejecting heat exchangers 6*b* or heat exchanger portions 6*a*, 6*b* may be twice as large as the heat rejecting capacity of a first one of the heat rejecting heat exchangers 6*a* or heat exchanger portions 6*a*, 6*b* in order to allow to switch between one third (33%) of the maximum heat rejecting capacity by respectively activating only the first one of the heat rejecting heat exchangers 6*a*, 6*b* or heat exchanger portions 6*a*, 6*b*, two thirds (66%) of the maximum heat rejecting capacity by activating only the second one of the heat rejecting heat exchangers 6*a*, 6*b*, or heat exchanger portions 6*a*, 6*b* and full (100%) heat rejecting capacity by activating both heat rejecting heat exchangers 6*a*, 6*b* or heat exchanger portions 6*a*, 6*b*.

Of course, heat rejecting heat exchangers 6*a*, 6*b* with any other heat rejecting capacity ratio can be provided, and further heat rejecting heat exchangers 6*a*, 6*b* or heat rejecting heat exchanger portions 6*a*, 6*b* may be added in order to allow an even finer adjustment of the heat rejecting capacity provided by the heat rejecting heat exchangers 6*a*, 6*b*.

A flash gas tap line 9 fluidly connects the upper gas space portion of the receiver 7 to the inlet side of the compressors 4*a*, 4*b*, 4*c* allowing to transfer flash gas from the receiver 7 directly to the inlet side of the compressors 4*a*, 4*b*, 4*c* in order to enhance the performance of the refrigeration circuit 1.

The system further comprises a control unit 22, which is connected by electrical lines, which are not shown in the FIGURE, to the compressors 4*a*, 4*b*, 4*c*, the switchable valves 5*a*, 5*b*, the regulation valve 16 and/or the fluid pump 20 in order to control the operation of said devices.

The control unit 22 may operate based on the temperature and pressure values measured by the heat receiving fluid temperature sensor 28, the refrigerant temperature sensor 24 and/or the refrigerant pressure sensor 26.

The control unit 22 may be realized in the form of a single control unit 22 or by a plurality of (sub-)control units 22*a*, 22*b*, each of the (sub-)control units 22*a*, 22*b* being configured to control different portions of the system. In particular, a first (sub-)control unit 22*a* may be provided for controlling the refrigeration circuit 1 and a second (sub-)control unit 22*b* may be provided for controlling the heat recovery system 14.

The control unit 22 may be configured to selectively switch the system between different modes in order to adjust the heat delivered from the refrigerant circulating within the refrigeration circuit 1 to the heat receiving fluid of the heat recovery system 14 according to the actual heat demand on the side of the heat recovery system 14.

In a first mode of operation, all the heat produced by the refrigeration circuit 1 is consumed by the heat recovery system 14. In this case, the regulation valve 16 is open and both switchable valves 5*a*, 5*b* are closed so that all the high pressure refrigerant leaving the compressors 4*a*, 4*b*, 4*c* flows through the second portion 2*b* of the pressure line 2 and the refrigeration circuit side 12*a* of the heat recovery heat exchanger 12 where it transfers its heat to the heat receiving fluid which is pumped by means of the fluid pump 20 through the heat recovery system side 12*b* of the heat recovery heat exchanger 12.

In a second mode of operation, the heat generated within the refrigeration circuit 1 exceeds the heat demand of the heat recovery system 14. In this case, the regulation valve 16 is controlled in order to adjust the flow of refrigerant through the refrigeration circuit side 12*a* of the heat recovery heat exchanger 12 and thereby the amount of heat transferred to the heat receiving fluid flowing through the heat recovery system side 12*b* of the heat recovery heat exchanger 12 to match the actual demand of the heat recovery system 14. Any additional heat, which is not consumed by the heat recovery system 14 is transferred to the environment by means of the heat rejecting heat exchanger(s) 6*a*, 6*b*. In particular, those heat rejecting heat exchangers 6*a*, 6*b* or heat rejecting heat exchanger portions 6*a*, 6*b* are activated by means of the switchable valves 5*a*, 5*b* that are necessary for transferring the remaining heat from the refrigerant circulating within the refrigeration circuit 1 to the environment.

If the heat rejecting capacity of one heat rejecting heat exchanger 6*a*, 6*b* or heat rejecting heat exchanger portion 6*a*, 6*b* is not sufficient in order to transfer all remaining heat from the refrigerant circulating within the refrigeration circuit 1, at least one additional heat rejecting heat exchanger 6*a*, 6*b* or heat rejecting heat exchanger portion 6*a*, 6*b* or all heat rejecting heat exchangers 6*a*, 6*b*/heat rejecting heat exchanger portions 6*a*, 6*b* are activated.

In a third mode of operation, no heat is demanded by the heat recovery system 14. In this case the regulation valve 16 is closed completely so that no refrigerant is flowing through the refrigeration circuit side 12*a* of the heat recovery heat exchanger 12. In this case, all the heat generated by the operation of the refrigeration circuit 1 is transferred from the refrigerant to the environment by means of at least one activated heat rejecting heat exchanger 6 or heat rejecting heat exchanger portion 6*a*, 6*b*. Likewise, those heat rejecting heat exchangers 6*a*, 6*b* or heat rejecting heat exchanger portion 6*a*, 6*b* are activated by means of the switchable valves 5*a*, 5*b* that are necessary for transferring the heat from the refrigerant circulating within the refrigeration circuit 1 to the environment.

The temperature of the heat receiving fluid flowing through the heat recovery system 14 is further adjustable by regulating the flow of the heat receiving fluid through the heat recovery system side 12*b* of the heat recovery heat exchanger 12 by means of the fluid pump 20.

The described embodiment allows to accurately adjust the heat which is recovered by means of the heat recovery heat exchanger 12 and transferred to the heat recovery system 14. It eliminates the problem of a two-phase refrigerant flow leaving the refrigeration circuit side 12*a* of the heat recovery heat exchanger 12 if the heat demand of the heat recovery system 14 is not big enough for absorbing all the heat generated by the operation of the refrigeration circuit 1. Thus, a refrigeration circuit 1 according to the disclosed embodiment does not need a liquid separator in order to separate the liquid phase refrigerating portion and the gaseous phase refrigerating portion from the circulating refrigerant. This reduces the costs of the refrigerating circuit 1.

The control of the refrigeration circuit 1 and/or the heat recovery system 14 can be effected by appropriate software running in the control unit 22. This avoids negative influences which may occur during operation on an end-user's side like changes of the demanded heat. The embodiment allows to use the heat rejecting heat exchanger 6 with two lockable coils avoiding the problem of holding the high pressure in the system on the required level during cold year seasons (winter mode).

According to exemplary embodiments, as described herein, a stable and safe operation of the refrigeration circuit is ensured the heat recovery system is active by controlling the heat transferred to the heat receiving fluid of the heat recovery system.

The control is comparably simple. If the regulation valve has been set to the appropriate position in order to effect the required heat exchange to the heat recovery system side by means of the heat recovery heat exchanger and, if applicable, the respective heat-rejecting heat exchanger has been activated in addition in order to transfer the remaining heat to the environment, the system is running in a stable and constant manner. The only changes in operation will be caused by changes in demand on the heat recovery system side or at the evaporators. The number of switching operations is reduced to a minimum.

According to exemplary embodiments, as described herein, all the heat generated by the refrigeration circuit is recovered, which contributes to a high energy efficiency.

In an embodiment the regulation valve is switchable between the open position, the closed position and at least one intermediate position dependent on the heat demand on the heat recovery system side of the heat recovery heat exchanger. This allows to regulate the heat transferred to the heat recovery system by means of the regulation valve to match the actual heat demand of an end-user connected to the heat recovery system.

In an embodiment the regulation valve comprises a plurality of intermediate positions. This allows a fine adjustment of the refrigerant flow flowing through the refrigeration circuit side of the heat recovery heat exchanger and thereby the heat transferred to the heat recovery system.

In an embodiment the opening degree (cross section) of the regulation valve is continuously variable between the closed position and the (completely) open position. This allows to continuously adjust the heat transferred from the refrigeration circuit to the heat recovery system.

In an embodiment the regulation valve is arranged downstream of the heat recovery heat exchanger. This avoids that a partially opened regulation valve, i.e. a regulation valve which has been switched to an intermediate position, acts as a throttle partially expanding the refrigerant circulating within the refrigeration circuit upstream of the heat recovery heat exchanger and thereby degenerating the efficiency of the heat recovery heat exchanger.

In an embodiment the refrigeration circuit comprises at least two heat rejecting heat exchangers or heat rejecting heat exchanger portions. This allows to adjust the amount of heat rejected by the heat rejecting heat exchanger(s) by selectively activating and/or deactivating one or more of the heat rejecting heat exchangers or heat rejecting heat exchanger portions, respectively.

In an embodiment at least two of the heat rejecting heat exchangers or heat rejecting heat exchanger portions have different capacities. This provides additional options for adjusting the capacity provided by the activated heat rejecting heat exchangers or heat rejecting heat exchanger portions by activating an appropriate group of heat rejecting heat exchangers or heat rejecting heat exchanger portions.

In an embodiment a second heat rejecting heat exchanger or heat rejecting heat exchanger portion has a capacity which is twice as large as the capacity of a first heat rejecting heat exchanger or heat rejecting heat exchanger portion. This provides even more options for adjusting the capacity provided by the activated heat rejecting heat exchangers or heat rejecting heat exchanger portions by activating an appropriate group of heat rejecting heat exchangers or heat rejecting heat exchanger portions.

In an embodiment the refrigeration circuit comprises at least one switchable valve which is configured to control the flow of refrigerant flowing through a corresponding heat rejecting heat exchanger or heat rejecting heat exchanger portion. This allows to adjust the capacity provided by the heat rejecting heat exchangers or heat rejecting heat exchanger portions by opening and/or closing selected switchable valves.

In an embodiment a switchable valve is respectively associated to each of the heat rejecting heat exchangers or heat rejecting heat exchanger portions. This allows to activate and/or deactivate each of the heat rejecting heat exchangers or heat rejecting heat exchanger portions individually in order to adjust the capacity provided by the heat rejecting heat exchangers or heat rejecting heat exchanger portions.

In an embodiment at least one of the switchable valves is switchable only between a completely open and a completely closed position. This avoids that a partially opened switchable valve acts as a throttle expanding the refrigerant flowing through the refrigeration circuit upstream of the respective heat rejecting heat exchanger which would negatively effect the heat transferred from the refrigerant to the environment by means of the heat rejecting heat exchanger.

In one embodiment at least one of the switchable valves is a motor-actuated ball valve. This allows to conveniently open and close the switchable valve.

In one embodiment the at least one switchable valve is arranged upstream or downstream of the corresponding heat rejecting heat exchanger in order to allow to block the flow of refrigerant flowing into the respective heat rejecting heat exchanger.

In a further embodiment the heat recovery system comprises at least one fluid pump which is configured to pump a heat receiving fluid through the heat recovery system side of the heat recovery heat exchanger. This supports the flow of the heat receiving fluid through the heat recovery heat exchanger and enhances the transfer of heat from the refrigerant circulating within the refrigeration circuit to the heat receiving fluid.

An embodiment comprises a control unit which is configured for controlling at least the regulation valve. This allows to control the amount of heat transferred to the heat receiving fluid by controlling the at least one regulation valve.

An embodiment comprises a control unit which is configured for controlling the operation of the at least one compressor. This allows to control the refrigeration capacity of the refrigeration circuit in operation.

The control unit may be provided by a single control unit or by a couple of (sub-)control units, each of the (sub-)

control units being designated to a specific task or a group of specific tasks. In particular, a first (sub-)control unit may by designated to control the refrigeration circuit while a second (sub-)control unit is designated to control the heat recovery system. The (sub-)control units may be connected to each other in order to exchange signals coordinating their operation.

An embodiment comprises at least one refrigerant temperature sensor which is configured to measure the temperature of the refrigerant circulating within the refrigeration circuit 1. This allows to control the refrigeration circuit and the regulation valve based on the temperature of the refrigerant circulating within the refrigeration circuit.

An embodiment comprises at least one refrigeration pressure sensor which is configured to measure the pressure of the refrigerant flowing through the refrigeration circuit allowing to control the operation of the refrigeration circuit based on the measured pressure of the refrigerant circulating within the refrigeration circuit.

In an embodiment a fluid temperature sensor which is configured to measure the temperature of the heat receiving fluid circulating through the heat recovery system side of the heat recovery heat exchanger is provided allowing to control the operation of the refrigeration circuit based on the measured temperature of the heat receiving fluid flowing through the heat recovery system side of the heat recovery heat exchanger.

According to an embodiment of the invention, at first the regulation valve is switched to the position by which the heat exchange in the heat recovery heat exchanger meets the required heat demand, and then remaining heat, if present, is transferred to the environment by one or more of the heat rejecting heat exchangers. Thereby the heat demand in the heat recovery system is always met, and the heat rejecting heat exchanger(s) only have to be operated if there is remaining heat that is not utilized by the heat recovery system.

The method of operating a refrigeration circuit according to an embodiment of the invention comprises to control the regulation valve in dependency of the heat demand on the heat recovery system side of the heat recovery heat exchanger in order to transfer exactly the demanded amount of heat to the heat recovery system.

In an embodiment the regulation valve is controlled depending on the temperature and/or the pressure of the refrigerant circulating within the refrigeration circuit in order to optimize the amount of heat transferred to the heat recovery system.

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention is not limited to the particular embodiment disclosed, but that the invention will include all embodiments falling within the scope of the appended claims.

REFERENCE NUMERALS

1 refrigeration circuit
2 pressure line
2*a* first portion of the pressure line
2*b* second portion of the pressure line
4*a*, 4*b*, 4*c* compressor
5*a*, 5*b* switchable valve
6 heat rejecting heat exchanger
6*a*, 6*b* heat rejecting heat exchanger or heat rejecting heat exchanger portion
7 receiver
8 expansion device
10 evaporator
12 heat recovery heat exchanger
12*a* refrigeration circuit side of the heat recovery heat exchanger
12*b* heat recovery system side of the heat recovery heat exchanger
14 heat recovery system
16 regulation valve
19 fluid line
20 fluid pump
22 control unit
22*a* first (sub-)control unit
22*b* second (sub-)control unit
24 refrigerant temperature sensor
26 refrigerant pressure sensor
28 heat receiving fluid temperature sensor

The invention claimed is:

1. A refrigeration circuit circulating a refrigerant and comprising in the direction of flow of the refrigerant:
- at least one compressor;
- a pressure line attached to an outlet side of the at least one compressor;
- at least one heat rejecting heat exchanger;
- at least one expansion device; and
- at least one evaporator;
- the refrigeration circuit further comprising:
- at least one heat recovery heat exchanger having a refrigeration circuit side and heat recovery system side and being configured for transferring heat between the refrigeration circuit side and the heat recovery system side,
- wherein the pressure line branches into a first pressure line portion leading to the at least one heat rejecting heat exchanger and into a second pressure line portion leading to the refrigeration circuit side so that the refrigeration circuit side is fluidly connected in parallel to the at least one heat rejecting heat exchanger for flowing circulating refrigerant through the refrigeration circuit side; and
- at least one regulation valve, which fluidly connects an outlet side of the refrigeration circuit side of the at least one heat recovery heat exchanger with an inlet side of the at least one expansion device or with an inlet side of a receiver provided upstream of the at least one expansion device and which is configured for regulating the flow of refrigerant flowing through the refrigeration circuit side of the at least one heat recovery heat exchanger;
- wherein the at least one regulation valve is switchable between
  - an open position, in which the regulation valve is completely open;
  - a closed position, in which the regulation valve is completely closed; and
  - at least one intermediate position, in which the regulation valve is partially open;
- wherein the regulation valve is arranged downstream of the at least one heat recovery heat exchanger.

2. The refrigeration circuit of claim 1, wherein the regulation valve is switchable between the open position, the closed position and the at least one intermediate position dependent on heat demand on the heat recovery system side of the at least one heat recovery heat exchanger.

3. The refrigeration circuit of claim 1, wherein the regulation valve comprises a plurality of different intermediate positions.

4. The refrigeration circuit of claim 1, wherein an opening degree of the regulation valve is continuously variable between the open position and the closed position.

5. The refrigeration circuit of claim 1, comprising at least two heat rejecting heat exchangers.

6. The refrigeration circuit of claim 5, wherein the at least two heat rejecting heat exchangers have different capacities.

7. The refrigeration circuit of claim 6, wherein a second heat rejecting heat exchanger has a capacity which is twice as large as a capacity of a first heat rejecting heat exchanger.

8. The refrigeration circuit of claim 5, further comprising at least two switchable valves, wherein a switchable valve is associated to each of the at least two heat rejecting heat exchangers and wherein each of the switchable valves is configured for controlling flow of refrigerant flowing through the associated heat rejecting heat exchanger.

9. The refrigeration circuit of claim 5, wherein the at least two heat rejecting heat exchangers are portions of a common heat rejecting heat exchanger.

10. The refrigeration circuit of claim 1, further comprising at least one switchable valve which is configured for controlling the flow of refrigerant flowing through an associated heat rejecting heat exchanger.

11. The refrigeration circuit of claim 10, wherein the at least one switchable valve is switchable only between a completely open and a completely closed state.

12. The refrigeration circuit of claim 10, wherein at least one switchable valve is a motor-actuated ball valve.

13. The refrigeration circuit of claim 10, wherein the at least one switchable valve is arranged upstream or downstream of the associated heat rejecting heat exchanger.

14. The refrigeration circuit of claim 10 further comprising a control unit which is configured for controlling the at least one switchable valve.

15. The refrigeration circuit of claim 1 further comprising a fluid pump which is configured for pumping a heat receiving fluid through the at least one heat recovery system side of the heat recovery heat exchanger.

16. The refrigeration circuit of claim 15 further comprising a control unit which is configured for controlling the fluid pump.

17. The refrigeration circuit of claim 1 further comprising a control unit which is configured for controlling the at least one regulation valve.

18. The refrigeration circuit of claim 1 further comprising at least one refrigerant temperature sensor which is configured for measuring a temperature of the refrigerant circulating in the refrigeration circuit.

19. The refrigeration circuit of claim 1 further comprising at least one refrigerant pressure sensor which is configured for measuring a pressure of the refrigerant circulating in the refrigeration circuit.

20. The refrigeration circuit of claim 1 further comprising at least one fluid temperature sensor which is configured for measuring a temperature of a heat receiving fluid flowing through the heat recovery system side of the at least one heat recovery heat exchanger.

21. The refrigeration circuit of claim 1 wherein the first pressure line portion leading from the compressor to the at least one heat rejecting heat exchanger does not pass through a four-way valve.

22. A method of operating a refrigeration circuit with a circulating refrigerant and comprising in the direction of flow of the refrigerant:

at least one compressor;

a pressure line attached to an outlet side of the at least one compressor;

at least one heat rejecting heat exchanger;

at least one expansion device; and at least one evaporator;

the refrigeration circuit further comprising:

at least one heat recovery heat exchanger comprising a refrigeration circuit side and heat recovery system side and being configured for transferring heat from the circulating refrigerant to a heat recovery system, wherein the pressure line branches into a first pressure line portion leading to the at least one heat rejecting heat exchanger and into a second pressure line portion leading to the refrigeration circuit side so that the refrigeration circuit side is connected in parallel to the at least one heat rejecting heat exchanger for flowing refrigerant through the refrigeration circuit side; and a regulation valve, which fluidly connects an outlet side of the refrigeration circuit side of the at least one heat recovery heat exchanger with an inlet side of the at least one expansion device or with an inlet side of a receiver provided upstream of the at least one expansion device and which is configured for regulating the flow of refrigerant flowing through the refrigerant circuit side of the at least one heat recovery heat exchanger, wherein the method comprises regulating the flow of refrigerant flowing through the refrigeration circuit side of the at least one heat recovery heat exchanger by controlling the regulation valve to be switched between an open position, in which the regulation valve is completely open;

a closed position, in which the regulation valve is completely closed; and at least one intermediate position in which the regulation valve is partially open;

wherein the regulation valve is arranged downstream of the at least one heat recovery heat exchanger.

23. The method of claim 22, wherein the regulation valve is controlled dependent on the heat demand on the heat recovery system side of the at least one heat recovery heat exchanger.

24. The method of claim 22, wherein at first the regulation valve is switched to a position by which heat exchange in the at least one heat recovery heat exchanger meets a required heat demand, and remaining heat is transferred to an environment by the at least one heat rejecting heat exchanger.

25. The method of claim 22, wherein the regulation valve is controlled dependent on a temperature of the refrigerant circulating in the refrigeration circuit.

26. The method of claim 22, wherein the regulation valve is controlled dependent on a pressure of the refrigerant circulating in the refrigeration circuit.

* * * * *